US005465953A

United States Patent [19]

Takemoto et al.

[11] Patent Number: 5,465,953

[45] Date of Patent: Nov. 14, 1995

[54] BANK NOTE CONVEYING EQUIPMENT

[75] Inventors: Takatoshi Takemoto, Tokyo; Noriaki Kano; Eiji Ito, both of Hanamaki; Kozo Sekimoto, Sendai, all of Japan

[73] Assignee: Kabushiki Kaisha Ace Denken, Japan

[21] Appl. No.: 215,682

[22] Filed: Mar. 22, 1994

[51] Int. Cl.[6] ..... B65H 9/00

[52] U.S. Cl. ..... 271/234; 271/240; 271/251

[58] Field of Search ..... 271/234, 240, 271/248, 250, 251, 272

[56] References Cited

U.S. PATENT DOCUMENTS

| | | | |
|---|---|---|---|
| 252,477 | 1/1882 | Kneeland | 271/251 |
| 4,821,049 | 4/1989 | Eckl | 271/251 X |
| 5,136,144 | 8/1992 | Swinton et al. | 271/250 X |

FOREIGN PATENT DOCUMENTS

93/07588 4/1993 WIPO .

*Primary Examiner*—David H. Bollinger

*Attorney, Agent, or Firm*—Andrus, Sceales, Starke & Sawall

[57] ABSTRACT

A bank note conveying equipment which is capable of preventing a jam during conveyance of bank note caused by damaged bank note and any problems in collecting and storing the bank note in a bank note storing unit. Bank notes are held between a pinch roller and an endless belt on a bank note conveying path, and conveyed along the bank note conveying path according to the rotation of the endless belt. When the bank note deviates from the bank note conveying path, either of modifying rollers provided outside the bank note conveying path in the widthwise direction thereof holds the bank note therebetween and rotates so that the bank note may be brought back to the bank note conveying path, and thereby correcting the conveying posture.

6 Claims, 2 Drawing Sheets

BANK NOTE CONVEYING EQUIPMENT

BACKGROUND OF THE INVENTION a. Field of the Invention:

The present invention relates to a bank note conveying equipment for conveying a bank note, and more particularly to a bank note conveying equipment which conveys a bank note according to the rotation of an endless belt while holding the bank note between a pinch roller and the endless belt.

b. Description of the Related Art:

A conventional bank note conveying equipment has a driving pulley and a driven pulley disposed apart from each other and an endless belt provided between the driving pulley and the driven pulley. The endless belt is moved with the rotation of the driving pulley. The bank note in a bank note conveying path is held between a pinch roller and the endless belt, and the bank note is moved along the bank note conveying path according to the movement of the endless bell.

In such a conventional bank note conveying equipment, however, the bank note often becomes gradually inclined or skewed and a part of the bank note deviates from the bank note conveying path. The part of the bank note which deviates from the bank note conveying path is subject to damage such as folds due to collision with a guide member provided along the conveying path. Such damaged bank note may possibly be the cause of a jam in the bank note conveying path, and often prevents the collection and storage of the bank notes in a bank note storing unit provided, for example, at the end of a game island.

SUMMARY OF THE INVENTION

The present invention was made with a view to solving problems found in the prior art. It is therefore an object of the present invention to provide a bank note conveying equipment in which any problems ascribable to the damaged bank notes, such as a jam caused by damaged bank notes or the like or any difficulty in collecting the bank notes can be prevented from occurring during the conveyance of the bank notes.

To accomplish the aforementioned object, the present invention provides a bank note conveying equipment comprising:

an endless belt which is positioned to contact a surface of the bank note;

an endless belt driving mechanism for rotating the endless belt;

a pinch roller comprising a roller pair, one of which is positioned to oppose the endless belt and contact another surface of the bank note; and a pair of modifying rollers, being provided slightly apart from a bank note conveying path in the widthwise direction thereof, formed between the endless belt and the pinch roller in a predetermined width along the length of the endless belt, which holds a part of the bank note deviating from the bank note conveying path therebetween, and rotating so that the part of the bank note held therebetween may be brought back to the bank note conveying path again.

In the bank note conveying equipment, the pair of modifying rollers may be in a cylindrical shape and have each a rotating shaft, the rotating shaft being slanting with respect to the longitudinal direction of the bank note conveying path.

The bank note conveying equipment may further comprise a modifying roller driving mechanism for rotating one of the modifying roller pair so that the peripheral velocity of the modifying roller may be faster than that of the endless belt.

The modifying roller driving mechanism may comprise a support roller having a rotating shaft and being in contact with the endless belt and rotating at the same peripheral velocity as that of the endless belt, and the one of the modifying roller pair has an external diameter larger than that of the support roller and is mounted on the rotating shaft of the support roller so that the modifying roller may rotate together with the rotation of the support roller.

The bank note conveying equipment may further comprise another pair of modifying rollers provided at an opposite side of the bank note conveying path in the widthwise direction thereof.

The bank note is held between the endless belt and the pinch roller on the bank note conveying path and is moved along the conveying belt according to the rotation of the endless belt. When the bank note deviates from the bank note conveying path, a pair of the modifying rollers provided at the outside of the bank note conveying path in the widthwise direction, hold a part of the bank note deviating from the path, therebetween, and rotate so that the bank note is brought back to the bank note conveying path and the posture of the bank note is corrected. Similarly when the bank note deviates on the other side of the bank note conveying path, a pair of the modifying rollers provided at the other side of the bank note conveying path modify the position of the bank note during the conveyance.

When the modifying rollers have a slant rotating shaft with respect to the longitudinal direction of the bank note conveying path, as the bank note is conveyed from the upstream side to the downstream side of the bank note conveying path, the modifying rollers convey the bank note from the outside of the bank note conveying path to the inside thereof in a widthwise direction to correct the conveying posture of the bank note.

When a modifying roller driving mechanism is provided, the peripheral velocity of the modifying roller is faster than that of the endless belt.

The bank note moves according to the rotation of the endless belt, however, the part of the bank note deviating from the bank note conveying path moves faster than the endless belt, thereby the conveying posture is corrected.

If a flat belt is employed for the endless belt, the bank note is moved with its surface being stably supported on the flat belt over the widthwise direction thereof, and the possibility of the slanting of the bank note can thereby be reduced.

DESCRIPTION OF THE PREFERRED EMBODIMENT

Figure 1A:
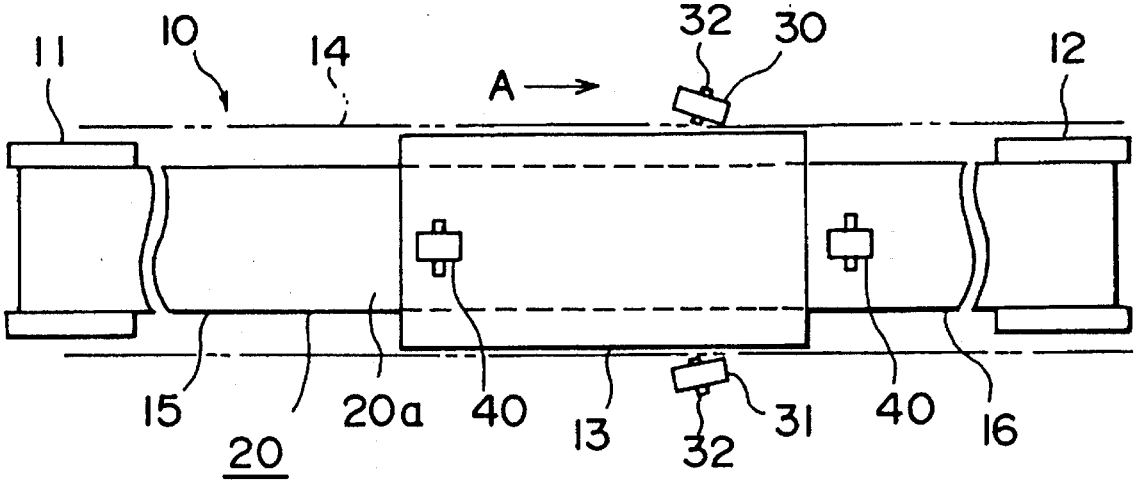
FIGS. 1(A) and 1(B) are each an explanatory front view of the bank note conveying equipment of the first embodiment according to the present invention.

The first embodiment of the present invention will now be explained referring to the drawings. FIGS. 1 and 2 show the first preferred embodiment according to the present invention.

Figure 2:
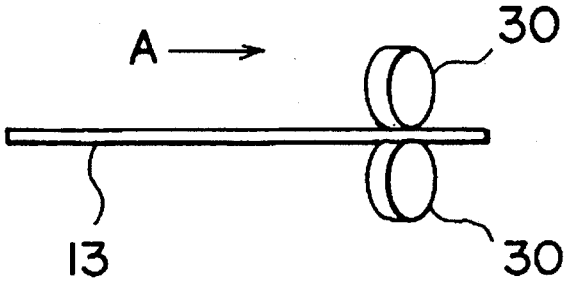
FIG. 2 is an explanatory plan view showing the modifying rollers of the bank note conveying equipment of the first embodiment according to the present invention.

As shown in FIG. 1(A), the bank note conveying equipment 10 comprises a driving pulley 11, a driven pulley 12, an endless belt 20, modifying rollers 30, 31, and pinch rollers 40. The bank note conveying equipment 10 is used, for example, in a game island (not shown) or the like in a game parlor to convey bank notes, which are paid by game players for the game media and stored in a game medium vending machine provided at both sides of the game island, from the game medium vending machine to a stacker or the like in a money exchange machine provided at an end of the game island.

A driving pulley 11 and a driven pulley 12 are provided along a bank note conveying path 14. The driving pulley 11 is rotated by a power source. An endless belt 20 is a flat belt and it is provided between the driving pulley 11 and the driven pulley 12 with its surface 20*a* along the bank note conveying path 14. Pairs of pinch rollers 40 are provided with the endless belt therebetween in the thicknesswise direction thereof. In short, one of each pinch roller pair 40 opposes the surface of the endless belt 20 (which comes in contact with the bank note), and the other pinch roller opposes the rear surface of the endless belt. The pairs of the pinch rollers are provided at the central portion of the bank note conveying path 14 in the widthwise direction of the path at the intervals equivalent to the length of the bank note 13. Although, the bank note conveying path 14 is explained above as if it is preliminarily formed, it is actually formed as a result of the arrangement of the endless belt 20 and pinch rollers 40 etc., between the endless belt 20 and the pinch rollers 40, along the length of the endless belt 20.

Due to the construction of the bank note conveying equipment 10 thus mentioned, the bank note is held between one of the pinch roller 40 and the endless belt 20 in the bank note conveying path 14, and moved on the bank note conveying path in the direction shown by an arrow A in FIG. 1 according to the rotation of the endless belt 20.

The modifying rollers 30, 31 are provided at both sides of the bank note conveying path 14 with the bank note conveying path positioned therebetween in a widthwise direction, at the intervals substantially equal to the length of the bank note. The position where the modifying rollers are provided does not correspond to that of the pinch rollers in the conveying path. As shown in FIG. 2, each of the modifying rollers 30, 31 comprises a roller pair arranged in the thicknesswise direction of the bank note conveying path 14. These modifying rollers 30, 31 have a rotating shaft 32 which is slanting from the inside of the bank note conveying path 14 to the out side of the bank note conveying path in the widthwise direction as viewed from the upstream side 15 to the downstream side 16. Shortly, the modifying rollers 30, 31 have a slant rotating shaft with respect to the longitudinal direction of the bank note conveying path 14. Each roller pair of the modifying rollers 30, 31 is not usually rotating. When the bank note 13 deviates from the bank note conveying path 14 and then contacts either of the modifying rollers, it begins rotating, holding the bank note between the roller pair of modifying roller to bring the bank note back to the bank note conveying path 14.

Now the operation will be explained.

In FIG. 1, the endless belt is rotated by the rotation of the driving pulley 11 in the direction shown by the arrow marked A. The bank note 13 is held between one of the pinch roller pair 40 and the endless belt 20 on the bank note conveying path 14 and moved on the bank note conveying path according to the rotation of the endless belt 20.

Figure 1B:
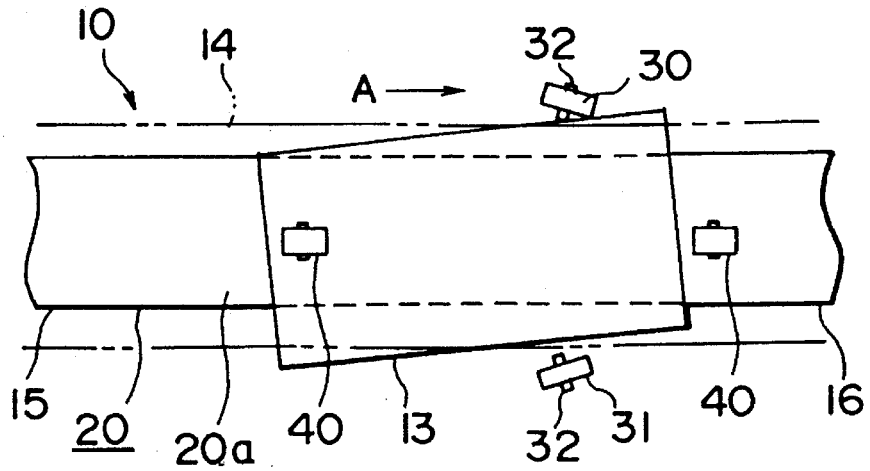

When the bank note 13 deviates from the bank note conveying path 14, as shown in FIG. 1(B), the roller pair of the modifying roller 30, 30 provided outside the bank note conveying path in its widthwise direction will hold the bank note 13 therebetween and rotate to bring the bank note back to the bank note conveying path 14. As the bank note is being conveyed from the upstream side 15 to the downstream side 16 of the bank note conveying path 14 by the rotation of the endless belt 20, the bank note is brought from the outside to the inside of the bank note conveying path 14 in the widthwise direction. By this operation, the conveying posture of the bank note 13 is corrected as shown in FIG. 1(A).

Similarly, when the bank note 13 deviates to the opposite side of the bank note conveying path 14, the modifying roller 31, 31 provided at the opposite side of the bank note conveying path 14 corrects the conveying posture.

Figure 3:
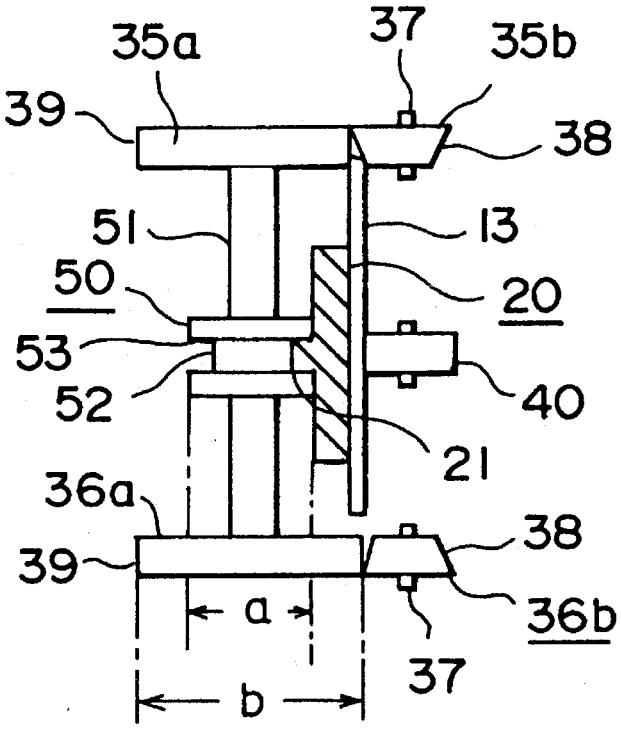
FIG. 3 is a side view of the bank note conveying equipment of the second embodiment according to the present invention.

The second embodiment according to the present invention will now be explained. FIG. 3 shows the second embodiment according to the present invention. The same reference numerals are used for the same members as in the embodiment 1, and overlapping explanation is omitted here.

In a bank note conveying equipment 10, similarly to the first embodiment, an endless belt 20 is provided between a driving pulley 11 and a driven pulley 12, and it is rotated according to the rotation of the driving pulley 11. As shown in FIG. 3, the bank note conveying equipment comprises a support roller 50. On the rear surface of the endless belt 20 ( which will not contact the bank note), a convex portion 21 is formed at the central portion of the endless belt 20 in the widthwise direction extending along length of the endless belt 20.

The support roller 50 has a rotating shaft 51 which extends in the widthwise direction of the bank note conveying path 14, and is provided at the opposite side of the bank note conveying path 14 with the endless belt 20 positioned therebetween, and at a position which does not correspond to the position of the pinch rollers. The support roller 50 has a groove 52 in which the convex portion 21 of the endless belt will fit so that the roller 50 may rotate according to the rotation of the endless belt 20.

The modifying roller pairs 35*a*, 35*b*, and 36*a*, 36*b* are provided at opposite side of the bank note conveying path 14, with the bank note conveying path 14 positioned therebetween in its widthwise direction as shown in FIG. 3. The modifying rollers 35*a*, 36*a*, of each modifying roller pairs 35*a*, 35*b* and 36*a*, 36*b* are provided at opposite ends of the rotating shaft 51 of the support roller 50, so that they may rotate according to the rotation of the support roller 50. As shown in FIG. 3, the modifying rollers 35*a*, 36*a* have a diameter b which is larger than the diameter a of the support roller 50.

The other modifying rollers 35*b*, 36*b*, of each modifying roller pairs 35*a*, 35*b* and 36*a*, 36*b* have a rotating shaft 37 which extends in the widthwise direction of the bank note conveying path 14. The rollers 35*b*, 36*b* are cone type friction rollers whose diameter is reduced or tapered as it goes from the outside to the inside in the widthwise direction.

Now, the operation of the second embodiment is explained.

When the support roller 50 rotates according to the rotation of the endless belt 20, the modifying rollers 35*a*, 36*a* mounted on the same rotating shaft as the support roller 50 also rotate with the support roller 50. The modifying rollers 35*a*, 36*a* having the same rotating shaft as the support roller 50, have the diameter larger than the support roller 50, so the velocity at the peripheral surface 39 is higher than that of the peripheral surface 53 of the support roller 50. Due to this, the peripheral velocity of the modifying rollers 35*a*, 36*a* is faster than that of the endless belt 20. On the other hand, the support roller 50 is in contact with the endless belt when rotating, so the peripheral velocity is substantially the same as that of the endless belt 20.

The bank note 13 is conveyed with the rotation of the endless belt 20. However, as shown in FIG. 3, a part of the bank note which deviates from the bank note conveying path 14 is moved faster than the endless belt 20 by the operation of the pair of modifying rollers 35*a*, 35*b*, so the bank note rotates itself with a part being held by the pinch roller 40 as its rotating center. The bank note is thereby brought back to the conveying path 14, with its posture corrected.

Similarly when the bank note 13*b* deviates from the bank note conveying path 14 to the opposite side, the pair of modifying rollers 36*a*, 36*b* provided at the opposite side correct the posture of the bank note.

In the bank note conveying equipment according to the present invention, when the bank note deviates from the bank note conveying path, a pair of modifying rollers rotates to bring the bank note back to the bank note conveying path and thereby the posture of the bank note is corrected. Therefore a jam during the conveyance caused by the damaged bank note and any difficulties in collecting and storing the bank note into the bank note storing unit can be prevented.

What is claimed is

1. A bank note conveying equipment for conveying a bank note comprising:

an endless belt forming a bank note conveying path, said belt being positioned to contact a surface of said bank note;

an endless belt driving mechanism for rotating said endless belt;

at least one pinch roller pair, one pinch roller of said pair being positioned to oppose said endless belt and contact another surface of said bank note; and a pair of modifying rollers spaced from said belt in the widthwise direction thereof, said pair of modifying rollers holding a part of a bank note deviating from said bank note conveying path therebetween;

a modifying roller driving mechanism for rotating one of said modifying rollers of said pair so that the peripheral velocity of said one modifying roller may be faster than the velocity of said endless belt, so that the deviated bank note may be rotated back into alignment with said bank note conveying path.

2. A bank note conveying equipment according to claim 1, wherein said modifying roller driving mechanism comprises a support roller having a rotating shaft and being in contact with said endless belt and rotating at a peripheral velocity corresponding to a velocity of said endless belt, and said one roller of the modifying roller pair has an external diameter larger than that of said support roller and is mounted to said rotating shaft of said support roller so that said one roller of said modifying roller pair may rotate together with the rotation of said support roller.

3. A bank note conveying equipment according to claim 1, further comprising another pair of modifying rollers provided at an opposite side of said belt in the widthwise direction thereof from said pair of modifying rollers.

4. A bank note conveying equipment according to claim 1, wherein said endless belt is a flat belt.

5. A bank note conveying equipment for conveying a bank note comprising:

an endless belt forming a bank note conveying path which lies between edges of said belt, said belt being positioned to contact a surface of said bank note;

an endless belt driving mechanism for rotating said endless belt;

at least one pinch roller pair, one pinch roller of said pair being positioned to oppose said endless belt and contact another surface of said bank note; and two pairs of modifying rollers, one pair of which is provided proximate to each edge of said belt, said pairs of modifying rollers being spaced from said belt in the widthwise direction thereof, said pair of modifying rollers holding a part of a bank note deviating from said bank note conveying path therebetween, so that the deviated bank note held therebetween may be rotated back into alignment with said bank note conveying path;

each roller of said pair of modifying rollers being in a cylindrical shape and having a rotating shaft, said rotating shaft being slanting with respect to the direction of movement of a bank note along said bank note conveying path.

6. A bank note conveying equipment according to claim 5, wherein said endless belt is a flat belt.

* * * * *